US008881496B2

(12) United States Patent
Bosman et al.

(10) Patent No.: US 8,881,496 B2
(45) Date of Patent: Nov. 11, 2014

(54) COATED HIGH STRENGTH FIBERS

(75) Inventors: Rigobert Bosman, Landgraaf (NL); Gerardus Aben, Montfort (NL); Hans Schneiders, Gulpen (NL)

(73) Assignee: DSM IP Assets B.V., Heerlen (NL)

( * ) Notice: Subject to any disclaimer, the term of this patent is extended or adjusted under 35 U.S.C. 154(b) by 299 days.

(21) Appl. No.: 13/389,152

(22) PCT Filed: Jul. 26, 2010

(86) PCT No.: PCT/EP2010/060813

§ 371 (c)(1),
(2), (4) Date: Apr. 23, 2012

(87) PCT Pub. No.: WO2011/015485

PCT Pub. Date: Feb. 10, 2011

(65) Prior Publication Data

US 2012/0198808 A1 Aug. 9, 2012

(30) Foreign Application Priority Data

Aug. 4, 2009 (EP) ..... 09167161

(51) Int. Cl.

| | |
|---|---|
| ***D07B 5/00*** | (2006.01) |
| ***D07B 1/14*** | (2006.01) |
| ***D06M 15/643*** | (2006.01) |
| ***D04C 1/12*** | (2006.01) |
| *D07B 1/02* | (2006.01) |

(52) U.S. Cl.

CPC ..... *D07B 1/142* (2013.01); *D07B 2201/2036* (2013.01); *D07B 2401/207* (2013.01); *D07B 2201/2041* (2013.01); *D07B 2205/2096* (2013.01); *D07B 1/14* (2013.01); *D07B 1/02* (2013.01); *D07B 2501/2061* (2013.01); *D07B 2201/2012* (2013.01); *D07B 2501/2038* (2013.01); *D07B 2201/1096* (2013.01); *D07B 2205/2046* (2013.01); *D07B 2207/404* (2013.01); *D07B 2201/2076* (2013.01); *D06M 15/643* (2013.01); *D04C 1/12* (2013.01); *D07B 2201/2087* (2013.01); *D07B 2201/2088* (2013.01); *D07B 2201/1092* (2013.01); *D07B 1/025* (2013.01); *D07B 2205/2014* (2013.01); *D07B 2201/104* (2013.01); *D07B 2207/4072* (2013.01); *D07B 2205/2071* (2013.01); *D07B 2401/206* (2013.01); *D07B 2201/2044* (2013.01); *D07B 2205/205* (2013.01); *D07B 2201/1004* (2013.01); *D07B 2201/102* (2013.01); *D07B 2205/507* (2013.01)

USPC ..... 57/258

(58) Field of Classification Search

USPC ..... 57/7, 232, 250, 258

See application file for complete search history.

(56) References Cited

U.S. PATENT DOCUMENTS

| | | | | |
|---|---|---|---|---|
| 3,029,590 | A | 4/1962 | Caroselli | |
| 4,022,010 | A * | 5/1977 | Gladenbeck et al. | 57/231 |
| 7,823,496 | B2 * | 11/2010 | Bosman et al. | 87/9 |
| 8,240,119 | B2 * | 8/2012 | Fujimoto et al. | 57/230 |
| 2002/0122946 | A1 | 9/2002 | Kuck | |
| 2006/0115656 | A1 | 6/2006 | Martin | |
| 2006/0213174 | A1 * | 9/2006 | Wu | 57/237 |
| 2009/0165637 | A1 * | 7/2009 | Bosman et al. | 87/9 |
| 2010/0199624 | A1 * | 8/2010 | Tatemoto et al. | 57/250 |
| 2013/0205742 | A1 * | 8/2013 | Smeets et al. | 57/212 |

FOREIGN PATENT DOCUMENTS

| | | |
|---|---|---|
| DE | GM 74 38 919 | 8/1975 |
| EP | 0 316 141 | 5/1989 |
| EP | 0 579 132 A1 | 1/1994 |
| JP | 2-127568 | 5/1990 |
| JP | 2005-144628 | 6/2005 |
| JP | 2005-534481 | 11/2005 |
| JP | 2007-70626 | 3/2007 |
| WO | WO 98/20505 | 5/1998 |
| WO | WO 2007/062803 | 6/2007 |
| WO | WO 2007/101032 | 9/2007 |

OTHER PUBLICATIONS

International Search Report for PCT/EP2010/060813, mailed Jan. 11, 2011.

Written Opinion of the International Searching Authority for PCT/JP2010/060813, mailed Jan. 11, 2011.

* cited by examiner

*Primary Examiner* — Shaun R Hurley

(74) *Attorney, Agent, or Firm* — Nixon & Vanderhye P.C.

(57) ABSTRACT

The invention relates to a high strength fibers comprising a coating of cross-linked silicone polymer, and ropes made thereof. The fibers are preferably high performance polyethylene (HPPE) fibers. The coating comprising a cross-linked silicone polymer is made from a coating composition comprising a cross-linkable silicone polymer. The rope shows markedly improved service life performance in bending applications such as cyclic bend-over-sheave applications. The invention also relates to the use of a cross-linked silicone polymer in a rope for an improvement of bend fatigue resistance.

18 Claims, No Drawings

COATED HIGH STRENGTH FIBERS

This application is the U.S. national phase of International Application No. PCT/EP2010/060813, filed 26 Jul. 2010, which designated the U.S. and claims priority to EP Application No. 09167161.0, filed 4 Aug. 2009, the entire contents of each of which are hereby incorporated by reference.

The invention relates to coated high strength fibers and the use of such fibers for making a rope. Such a rope is particularly suitable for applications involving repeated bending of the rope. The invention also relates to the manufacturing method of the coated fibers and the rope.

Applications involving repeated bending of a rope, hereinafter also referred as bending applications, include bend-over-sheave applications. A rope for bend-over-sheave applications is within the context of the present application considered to be a load-bearing rope typically used in lifting or installation applications; such as marine, oceanographic, offshore oil and gas, seismic, commercial fishing and other industrial markets. During such uses, together referred to as bend-over-sheave applications, the rope is frequently pulled over drums, bitts, pulleys, sheaves, etc., a.o. resulting in rubbing and bending of the rope. When exposed to such frequent bending or flexing, a rope may fail due to rope and fiber damage resulting from external and internal abrasion, frictional heat, etc.; such fatigue failure is often referred to as bend fatigue or flex fatigue.

A drawback of known ropes remains a limited service life when exposed to frequent bending or flexing. Accordingly, there is a need in industry for ropes that show improved performance in bending applications during prolonged times.

In order to reduce, amongst others, loss of strength resulting from internal abrasion between the fibers in the rope, applying a specific mixture of polymer fibers in the rope strands is proposed in U.S. Pat. No. 6,945,153 B2. U.S. Pat. No. 6,945,153 B2 describes a braided rope of construction, wherein the strands contain a mixture of high-performance polyethylene fibers and lyotropic or thermotropic polymer fibers, in a ratio of 40:60 to 60:40. The lyotropic or thermotropic liquid crystalline fibers, like aromatic polyamides (aramids) or polybisoxazoles (PBO) are indicated to provide good resistance to creep rupture, but to be very susceptible to self-abrasion; whereas HPPE fibers are mentioned to exhibit the least amount of fiber-to-fiber abrasion, but to be prone to creep failure.

Ropes to be used in bend-over sheave applications which comprise high tenacity polyolefine fibers are known from WO2007/101032 and WO2007/062803. In WO2007/101032 the rope is constructed from fibers coated with a (fluid) composition comprising an amino functional silicone resin and a neutralized low molecular weight polyethylene wax. WO2007/062803 describes a rope constructed from high performance polyethylene fibers and polytetrafluoroethylene fibers. The rope can contain 3-18 mass % silicone compounds which are fluid polyorganosiloxanes.

Thus, according to the prior art it has been suggested to use fluid silicone compositions, also referred to as silicon oils, to coat high strength fibers to be used in ropes for bend-over sheave applications. A drawback of such oil is, that when the rope is put under tension and at increasing temperature, the silicon oil tends to be "pushed" out of the rope, and thus looses its beneficial effect on the rope performance.

The object of the invention is therefore to provide a high strength fiber and a rope made of such a high strength fiber that has improved properties for bending applications. Another object is to provide a rope that has improved properties for bending applications.

This object is achieved according to the invention with a high strength fiber coated with a cross-linked silicone polymer. The coating is preferably made from a coating composition comprising a cross-linkable silicone polymer.

The advantages of the coated high strength fibers of the invention are an improved abrasion protection of the fibers when a rope is made out of such fibers. Moreover, the use of a cross-linked, or cured, silicone coating results in a coating that does not wash out and that is flexible and heat resistant.

In particular, the coating has excellent compatibility with high strength fibers, in particular with HPPE fibers.

It has been found that when high strength fibers are provided with a coating comprising a cross-linked silicone polymer, a rope made using such fibers has a surprisingly improved bend fatigue resistance. The invention thus also provides a rope containing high strength fibers, wherein the high strength fibers are coated with a cross-linked silicone polymer.

According to a second aspect, the invention provides a rope comprising high strength fibers, wherein the rope is provided with a coating comprising a cross-linked silicone polymer.

Other advantages of the rope according to the invention include that the rope has high strength efficiency, meaning the strength of the rope is a relatively high percentage of the strength of its constituting fibers. The rope also shows good performance on traction (storage) and drum winches, and can be easily inspected for possible damage.

The present invention therefore also relates to the use of a rope of construction and composition as further detailed in this application as a load-bearing member in bending applications, for example bend-over-sheave applications such as hoisting applications. The rope is further suited for use in applications where a fixed part or parts of the rope is repeatedly bent over a prolonged period of time. Examples include applications for subsea installations, mining, renewable energy and so on.

The present invention also relates to the use of a cross-linked silicone polymer in a rope for an improvement of bend fatigue resistance.

In the present invention, the coating on the high strength fibers or rope is obtained by applying a coating composition comprising a cross-linkable silicone polymer. After the application of the coating composition to the rope or the fibers, the coating composition may be cured, e.g. by heating to cause cross-linking of the cross-linkable silicone polymer. The cross-linking may also be induced by any other suitable methods known to the skilled person. The temperature for curing the coating composition is from 20 to 200° C., preferably from 50 to 170° C., more preferably 120 to 150° C. The curing temperature should not be too low, for the curing to be effective. Should the curing temperature become too high, there is a risk that the high strength fiber deteriorates and loses its strength.

The weight of the rope or the fibers before and after coating followed by curing is measured to calculate the weight of the cross-linked coating. For a fiber, the weight of the cross-linked coating is 1 to 20 wt. %, based on the total weight of the fiber, preferably 1 to 10 wt. %. For a rope, preferably, the weight of the cross-linked coating is 1 to 30 wt. % based on the total weight of rope and coating, preferably 2 to 15 wt. %.

The degree of the cross-linking may be controlled. The degree of the cross-linking may be controlled by e.g. the temperature or the time period of the heating. The degree of the cross-linking, if performed in other ways, may be controlled in methods known to the skilled person. The measurement of the degree of the cross-linking may be performed as follows:

The rope or the fibers provided with the (at least partially) cross-linked coating is dipped in a solvent. The solvent is chosen with which the extractables (mainly monomers) groups in the polymer would dissolve which are not cross-linked and the cross-linked network would not dissolve. A preferred solvent is hexane. By weighing the rope or the fibers after the dipping in such a solvent, the weight of the non-cross-linked portion can be determined and the ratio of the cross-linked silicone to the extractables can be calculated.

The preferred degree of cross-linking is at least 20%, i.e. at least 20 wt %, based on the total weight of the coating, of the coating remains on the fibers or rope after extraction with the solvent. More preferably the degree of cross-linking is at 30%, most preferably at least 50%. The maximum degree of cross-linking is about 100%.

Preferably, the cross-linkable silicone polymer comprises a silicone polymer having a reactive end-group. It was found that a cross-linking in the end-groups of the silicone polymer results in a good bending resistance. A silicone polymer which is cross-linked at the end groups rather than at the branches in the repeating unit results in a less rigid coating. Without being limited thereto, the inventors attribute the improved properties of the rope to the less rigid structure of the coating.

Preferably, the cross-linkable end-group is an alkylene end group, more preferably a $C_2$-$C_6$ alkylene end group. In particular the end group is a vinyl group or a hexenyl group. In general, a vinyl group is preferred.

Preferably, the cross-linkable silicone polymer has the formula:

$$CH_2{=}CH{-}(Si(CH_3)_2{-}O)_n{-}CH{=}CH_2 \quad (1)$$

wherein n is a number from 2 to 200, preferably from 10 to 100, more preferably from 20 to 50.

Preferably, the coating composition further contains a cross-linker. The cross-linker preferably has the formula:

$$Si(CH_3)_3{-}O{-}(SiCH_3H{-}O)_m{-}Si(CH_3)_3 \quad (2)$$

wherein m is a number n is a number from 2 to 200, preferably from 10 to 100, more preferably from 20 to 50.

Preferably, the coating composition further comprises a metal catalyst for cross-linking the cross-linkable silicone polymer, the metal catalyst preferably being a platinum, palladium or rhodium, more preferably platinum metal complex catalyst. Such catalysts are known to the skilled person.

Preferably, the coating composition is a multi-component silicone system comprising a first emulsion comprising the cross-linkable silicone polymer and the cross-linker and a second emulsion comprising the cross-linkable silicone polymer and the metal catalyst.

Preferably, the weight ratio between the first emulsion and the second emulsion is from about 100:1 to about 100:30, preferably 100:5 to 100:20, more preferably 100:7 to 100:15.

The coating compositions as described above are known in the art. They are often referred to as addition-curing silicone coatings or coating emulsions. The cross-linking or curing takes place when the vinyl end groups react with the SiH group of the cross-linker.

Examples of such coatings are Dehesive® 430 (cross-linker) and Dehesive® 440 (catalyst) from Wacker Silicones; Silcolease® Emulsion 912 and Silcolease® catalyst 913 from Bluestar Silicones; and Syl-off® 7950 Emulsion Coating and Syl-off® 7922 Catalyst Emulsion from Dow Corning.

A further advantage of the invention is that the cross-linked silicone can be used as a carrier for other functional additives. Thus the invention also relates to a fiber coated with a cross-linked silicone polymer coating, wherein the coating further contains an additive, selected from colorants, anti-oxidants and antifouling agents.

Such additives are known in the art. Examples of antifouling agents are for instance copper and copper complexes, metal pyrithiones and carbamate compounds.

Within the context of the present invention, fibers are understood to mean elongated bodies of indefinite length and with length dimension much greater than width and thickness. The term fiber thus includes a monofilament, a multifilament yarn, a ribbon, a strip or tape and the like, and can have regular or irregular cross-section. The term fibers also includes a plurality of any one or combination of the above.

Thus, according to the invention the coating of a cross-linked silicone polymer can be applied on the filaments, but also on the multifilament yarn. Moreover, it is also an embodiment of the invention to provide a strand including high strength fibers, wherein the strand is coated with a cross-linked silicone polymer.

Fibers having the form of monofilaments or tape-like fibers can be of varying titer, but typically have a titer in the range of 10 to several thousand dtex, preferably in the range of 100 to 2500 dtex, more preferably 200-2000 dtex. Multi-filament yarns contain a plurality of filaments having a titer typically in the 0.2-25 dtex range, preferably about 0.5-20 dtex. The titer of a multifilament yarn may also vary widely, for example from 50 to several thousand dtex, but is preferably in the range of about 200-4000 dtex, more preferably 300-3000 dtex.

With high strength fibers for use in the invention fibers are meant having a tenacity of at least 1.5 N/tex, more preferably at least 2.0, 2.5 or even at least 3.0 N/tex. Tensile strength, also simply strength, or tenacity of filaments are determined by known methods, as based on ASTM D2256-97. Generally such high-strength polymeric filaments also have a high tensile modulus, e.g. at least 50 N/tex, preferably at least 75, 100 or even at least 125 N/tex.

Examples of such fibers are high performance polyethylene (HPPE) fibers, fibers manufactured from polyaramides, e.g. poly(p-phenylene terephthalamide) (known as Kevlar®; poly(tetrafluoroethylene) (PTFE); aromatic copolyamid (co-poly-(paraphenylene/3,4'-oxydiphenylene terephthalamide)) (known as Technora®); poly{2,6-diimidazo-[4,5b-4',5'e]pyridinylene-1,4(2,5-dihydroxy)phenylene} (known as M5); poly(p-phenylene-2,6-benzobisoxazole) (PBO) (known as Zylon®); thermotropic liquid crystal polymers (LCP) as known from e.g. U.S. Pat. No. 4,384,016; but also polyolefins other than polyethylene e.g. homopolymers and copolymers of polypropylene. Also combinations of fibers manufactured from the above referred polymers can be used in the rope of the invention. Preferred high-strength fibers however are fibers of HPPE, polyaramides or LCP.

Most preferred fibers are high performance polyethylene (HPPE) fibers. HPPE fibers are herein understood to be fibers made from ultra-high molar mass polyethylene (also called ultra-high molecular weight polyethylene; UHMWPE), and having a tenacity of at least 1.5, preferably at least 2.0, more preferably at least 2.5 or even at least 3.0 N/tex. There is no reason for an upper limit of tenacity of HPPE fibers in the rope, but available fibers typically are of tenacity at most about 5 to 6 N/tex. The HPPE fibers also have a high tensile modulus, e.g. of at least 75 N/tex, preferably at least 100 or at least 125 N/tex. HPPE fibers are also referred to as high-modulus polyethylene fibers.

In a preferred embodiment, the HPPE fibers in the rope according to the invention are one or more multi-filament yarns.

HPPE fibers, filaments and multi-filament yarn, can be prepared by spinning of a solution of UHMWPE in a suitable solvent into gel fibers and drawing the fibers before, during and/or after partial or complete removal of the solvent; that is via a so-called gel-spinning process. Gel spinning of a solution of UHMWPE is well known to the skilled person; and is described in numerous publications, including EP 0205960 A, EP 0213208 A1, U.S. Pat. No. 4,413,110, GB 2042414 A, EP 0200547 B1, EP 0472114 B1, WO 01/73173 A1, and in Advanced Fiber Spinning Technology, Ed. T. Nakajima, Woodhead Publ. Ltd (1994), ISBN 1-855-73182-7, and in references cited therein, all incorporated herein by reference.

HPPE fibers, filaments and multi-filament yarn can also be prepared by melt-spinning of UHMWPE, although the mechanical properties such as tenacity are more limited compared to HPPE fibers made by the gel-spinning process. The upper limit of the molecular weight of the UHMWPE which can be melt-spun is lower than the limit with the gel-spinning process. The melt-spinning process is widely known in the art, and involves heating a PE composition to form a PE melt, extruding the PE melt, cooling the extruded melt to obtain a solidified PE, and drawing the solidified PE at least once. The process is mentioned e.g. in EP1445356A1 and EP1743659A1, which are incorporated herein by reference.

UHMWPE is understood to be polyethylene having an intrinsic viscosity (IV, as measured on solution in decalin at 135° C.) of at least 5 dl/g, preferably of between about 8 and 40 dl/g. Intrinsic viscosity is a measure for molar mass (also called molecular weight) that can more easily be determined than actual molar mass parameters like $M_n$ and $M_w$. There are several empirical relations between IV and $M_w$, but such relation is dependent on molar mass distribution. Based on the equation $M_w=5.37*10^4\ [IV]^{1.37}$ (see EP 0504954 A1) an IV of 8 dl/g would be equivalent to $M_w$ of about 930 kg/mol. Preferably, the UHMWPE is a linear polyethylene with less than one branch per 100 carbon atoms, and preferably less than one branch per 300 carbon atoms; a branch or side chain or chain branch usually containing at least 10 carbon atoms. The linear polyethylene may further contain up to 5 mol % of one or more comonomers, such as alkenes like propylene, butene, pentene, 4-methylpentene or octene.

In one embodiment, the UHMWPE contains a small amount, preferably at least 0.2, or at least 0.3 per 1000 carbon atoms, of relatively small groups as pending side groups, preferably a C1-C4 alkyl group. Such a fiber shows an advantageous combination of high strength and creep resistance. Too large a side group, or too high an amount of side groups, however, negatively affects the process of making fibers. For this reason, the UHMWPE preferably contains methyl or ethyl side groups, more preferably methyl side groups. The amount of side groups is preferably at most 20, more preferably at most 10, 5 or at most 3 per 1000 carbon atoms.

The HPPE fibers in the rope according to the invention may further contain small amounts, generally less than 5 mass %, preferably less than 3 mass % of customary additives, such as anti-oxidants, thermal stabilizers, colorants, flow promoters, etc. The UHMWPE can be a single polymer grade, but also a mixture of two or more different polyethylene grades, e.g. differing in IV or molar mass distribution, and/or type and number of comonomers or side groups.

The rope according to the invention is a rope especially suited for bending applications such as bend-over-sheave applications. A rope having a large diameter e.g. at least 16 mm is suitable for certain bending applications. The diameter of the rope is measured at the outmost circumference of the rope. This is because of irregular boundaries of ropes defined by the strands. Preferably, the rope according to the invention is a heavy-duty rope having a diameter of at least 30 mm, more preferably at least 40 mm, at least 50 mm, at least 60 mm, or even at least 70 mm. Largest ropes known have diameters up to about 300 mm, ropes used in deepwater installations typically have a diameter of up to about 130 mm.

The rope according to the invention can have a cross-section that is about circular or round, but also an oblong cross-section, meaning that the cross-section of a tensioned rope shows a flattened, oval, or even (depending on the number of primary strands) an almost rectangular form. Such oblong cross-section preferably has an aspect ratio, i.e. the ratio of the larger to the smaller diameter (or width to height ratio), in the range of from 1.2 to 4.0. Methods to determine the aspect ratio are known to the skilled person; an example includes measuring the outside dimensions of the rope, while keeping the rope taut, or after tightly winding an adhesive tape around it. The advantage of a non-circular cross section with said aspect ratio is that during cyclic bending where the width direction of the cross section is parallel to the width direction of the sheave, less stress differences occur between the fibers in the rope, and less abrasion and frictional heat occurs, resulting in enhanced bend fatigue life. The cross-section preferably has an aspect ratio of about 1.3-3.0, more preferably about 1.4-2.0.

In case of a rope with an oblong cross-section, it is more accurate to define the size of a round rope by the diameter of a round rope of same mass per length as the non-round rope, sometimes referred in the industry as an effective diameter. In this document the term 'diameter' means an effective diameter in case of a rope with an oblong cross-section.

Preferably, the rope and/or the fibers in the rope are further coated with a second coating for further improving bending fatigue. Such coatings, which can be applied to the fibers before construction of the rope, or onto the rope after it is constructed, are known and examples include coatings comprising silicone oil, bitumen and both. Polyurethane-based coating is also known, possibly mixed with silicone oil. The rope preferably contains the second coating of 2.5-35 wt % in a dried state. More preferably, the rope contains 10-15 wt % of the second coating.

In one embodiment of the present invention, the rope further includes synthetic fibers made of a polymer different from HPPE. These fibers may be of various polymer suitable for making a fiber, including polypropylene, nylon, aramid (e.g. ones known by the trade name of Kevlar®, Technora®, Twaron®), PBO (polyphenylene benzobisoxazole) (e.g. ones known by the trade name of Zylon®), thermotropic polymer (e.g. ones known by the trade name of Vectran®) and PTFE (polytetrafluoroethylene).

As the further synthetic fibers, PTFE fibers are preferred. The combination of HPPE fibers and PTFE fibers has been shown to improve service life performance in bending applications such as cyclic bend-over-sheave applications, as described in e.g. WO2007/062803A1. The PTFE fibers have a tenacity that is significantly lower than the HPPE fibers, and do not have effective contribution to the static tenacity of the rope. Nevertheless, the PTFE fibers preferably have a tenacity of at least 0.3, preferably at least 0.4 or at least 0.5 N/tex, in order to prevent breaking of fibers during handling, mixing with other fibers and/or during rope making. There is no reason for an upper limit of the tenacity of PTFE fibers, but available fibers typically are of tenacity of at most about 1 N/tex. The PTFE fibers typically have an elongation at break that is higher than that of HPPE fibers.

Properties of PTFE fibers and methods of making such fibers have been described in numerous publications, including EP 0648869 A1, U.S. Pat. No. 3,655,853, U.S. Pat. No. 3,953,566, U.S. Pat. No. 5,061,561, U.S. Pat. No. 6,117,547, and U.S. Pat. No. 5,686,033.

PTFE polymer is understood to be a polymer made from tetrafluoroethylene as main monomer. Preferably, the polymer contains less than 4 mole %, more preferably less than 2 or 1 mole % of other monomers, such as ethylene, chlorotrifluoroethylene, hexafluoropropylene, perfluoropropyl vinylether and the like. PTFE is generally a very high molar mass polymer, with high melting point and high crystallinity, which makes it virtually impossible to melt process the material. Also its solubility in solvents is very limited. PTFE fibers are therefore typically made by extruding mixtures of PTFE and optionally other components below the melting point of PTFE into a precursor fiber, for example a monofilament, tape or sheet, followed by sintering-like processing steps, and/or post-stretching the products at elevated temperatures. PTFE fibers are thus typically in the form of one or more monofilament- or tape-like structures, for example some tape-like structures twisted into a yarn-like product. PTFE fibers generally have certain porosity, depending on the process applied for making a precursor fiber and on applied post-stretching conditions. Apparent densities of PTFE fibers can vary widely, suitable products have densities in the range of about 1.2 to 2.5 g/cm$^3$.

In a further embodiment of the present invention, the rope comprises a core member around which fibers are braided. The construction with a core member is useful when it is desired that the braid does not collapse into an oblong shape and the rope retains its shape during use.

The rope may further contain thermally conductive fibers, such as metal fibers, preferably in the core. This embodiment is advantageous since the center of the rope usually has the highest temperature. With this embodiment, the heat generated and otherwise kept in the center of the rope is dissipated especially fast along the longitudinal direction. For applications where the same part of the rope is repeatedly exposed to bending, this is especially advantageous.

Preferably, the mass ratio of the HPPE fibers is 70-98 wt % to the total fibers in the rope. The strength of the rope highly depends on the amount of HPPE fibers in the rope since HPPE fibers contribute most to the strength.

In embodiments comprising a mixture of HPPE fibers and other fibers such as further synthetic fibers as described above, the mixture of the fibers may be at all levels. The mixture may be at rope yarns made from fibers, at strands made from rope yarns, and/or at the final rope made from strands. Some embodiments are shown in the following to illustrate possible rope constructions. It is noted that these embodiments are for illustrative purpose only and do not show all possible mixtures within the scope of the present invention.

In one embodiment, different types of fibers are formed into a rope yarn. The rope yarns are made into strands and the strands are made into the final composite rope.

In a further embodiment, each rope yarn is made from a single type of fibers, i.e. a first rope yarn is made from first fibers and a second rope yarn is made from second fibers, and so on. The first, second and optionally further rope yarns are made into strands and the strands are made into the final composite rope.

In a further embodiment, each rope yarn is made from a single type of fibers. Each strand is made from a single type of rope yarns. Strands each made from different type of fibers are made into the final composite rope.

In a further embodiment, some rope yarns or strands are made from one type of fibers and some rope yarns or strands are made from two or more type of fibers.

The rope according to the invention can be of various constructions, including laid, braided, parallel (with cover), and wire rope-like constructed ropes. The number of strands in the rope may also vary widely, but is generally at least 3 and preferably at most 16, to arrive at a combination of good performance and ease of manufacture.

Preferably, the rope according to the invention is of a braided construction, to provide a robust and torque-balanced rope that retains its coherency during use. There is a variety of braid types known, each generally distinguished by the method that forms the rope. Suitable constructions include soutache braids, tubular braids, and flat braids. Tubular or circular braids are the most common braids for rope applications and generally consist of two sets of strands that are intertwined, with different patterns possible. The number of strands in a tubular braid may vary widely. Especially if the number of strands is high, and/or if the strands are relatively thin, the tubular braid may have a hollow core; and the braid may collapse into an oblong shape.

The number of strands in a braided rope according to the invention is preferably at least 3. There is no upper limit to the number of strands, although in practice ropes will generally have no more than 32 strands. Particularly suitable are ropes of an 8- or 12-strand braided construction. Such ropes provide a favourable combination of tenacity and resistance to bend fatigue, and can be made economically on relatively simple machines.

The rope according to the invention can be of a construction wherein the lay length (the length of one turn of a strand in a laid construction) or the braiding period (that is the pitch length related to the width of a braided rope) is not specifically critical. Suitable lay lengths and braiding periods are in the range of from 4 to 20 times the diameter of the rope. A higher lay length or braiding period may result in a more loose rope having higher strength efficiency, but which is less robust and more difficult to splice. Too low a lay length or braiding period would reduce tenacity too much. Preferably therefore, the lay length or braiding period is about 5-15 times the diameter of the rope, more preferably 6-10 times the diameter of the rope.

In the rope according to the invention the construction of the strands, also referred to as primary strands, is not specifically critical. The skilled person can select suitable constructions like laid or braided strands, and twist factor or braiding period respectively, such that a balanced and torque-free rope results.

In a special embodiment of the invention each primary strand is itself a braided rope. Preferably, the strands are circular braids made from an even number of secondary strands, also called rope yarns, which comprise polymer fibers. The number of secondary strands is not limited, and may for example range from 6 to 32; with 8, 12 or 16 being preferred in view of available machinery for making such braids. The skilled man in the art can choose the type of construction and titer of the strands in relation to the desired final construction and size of the rope, based on his knowledge or with help of some calculations or experimentation.

The secondary strands or rope yarns containing polymer fibers can be of various constructions, again depending on the desired rope. Suitable constructions include twisted fibers; but also braided ropes or cords, like a circular braid, can be used. Suitable constructions are for example mentioned in U.S. Pat. No. 5,901,632.

The rope according to the invention can be made with known techniques for assembling a rope from polymer fibers. The coating composition comprising cross-linkable silicone polymers may be applied to the fibers and be cured to form a coating comprising a cross-linked silicone polymer, and then the fibers may be made into a rope. The coating composition comprising cross-linkable silicone polymers may also be applied after the rope has been formed. It is of course possible to apply the coating composition on rope yarns assembled from the fibers or on strands assembled from the rope yarns. It is preferable that the coating composition is applied to the fibers before the rope is constructed. The advantage of this is that homogeneous impregnation with the coating composition is achieved in the rope irrespective of the diameter of the rope.

One preferred method of making a rope comprising high strength fibers comprises the steps of applying a coating composition comprising a cross-linkable silicone polymer to the high strength fibers and/or the rope and subjecting the high strength fibers and/or the rope to a temperature of 120-150° C. to form a coating comprising a cross-linked silicone polymer on the rope and/or the HPPE fibers.

Although the applicability of the fibers of the invention is mainly described for ropes, other uses which are known for high strength fibers, are also within the scope of the invention. In particular the fibers can be used in the manufacture of a net, such as a fishing net. It has been shown that the fibers of the invention have a better knot strength compared to uncoated fibers.

The fibers can also be woven or otherwise assembled to create fabrics for different applications, such as in textiles.

Moreover, the fibers of the invention show an improved processability when making ropes or other articles out of the yarns. Better processability means that the yarn containing the fibers of the invention moves smoothly through the machines used for making the ropes and little damage occurs to the yarns where the yarns come into contact with the different elements of the machine, such as rollers, eyes, etc. Thus, the yarn can be more easily braided or woven.

Preferably, the coating composition is applied in two steps. In this preferred method, a first emulsion comprising the cross-linkable silicone polymer and a cross-linker and a second emulsion comprising the cross-linkable silicone polymer and a metal catalyst are mixed. The rope and/or the fibers are dipped in this mixture. The coating composition is then cured.

The dipping of the fibers into the coating composition may be done during the fiber production process. The production process of the fibers involves at least one drawing step. The drawing step may take place after the dipping step.

The method according to the invention may also further comprise a step of post-stretching the primary strands before the braiding step, or alternatively a step of post-stretching the rope. Such stretching step is preferably performed at elevated temperature but below the melting point of the (lowest melting) filaments in the stands (=heat-stretching); preferably at temperatures in the range 100-120° C. Such a post-stretching step is described in a.o. EP 398843 B1 or U.S. Pat. No. 5,901,632.

The present invention is described further in detail referring to examples.

COMPARATIVE EXAMPLE A

A rope having a diameter of 16 mm and consisting of HPPE fibers was produced. As HPPE fibers Dyneema™ SK 75, 1760 dtex was used, delivered by DSM in the Netherlands. The construction of the rope yarn was 8×1760 dtex, 20 turns per meter S/Z. From the yarns strands were produced. The strand construction was 1+6 rope yarns, 20 turns per meter Z/S. From the strands a rope was produced. The rope construction was 12 strand braided rope with a braiding period of 109 mm, i.e. about 7 times the rope diameter. The average breaking strength of the rope was 22.5 kN.

The bend fatigue of the rope was tested. In this test the rope was bent over a free rolling sheave having a diameter of 400 mm. The rope was placed under load and cycled back and forward over the sheave until the rope reached failure. Each machine cycle produced two straight-bent-straight bending cycles of the exposed rope section, the double bend zone. The double bend stroke was 30 times the diameter of the rope. The cycling period was 12 seconds per machine cycle. The force applied to the rope was 30% of the average breaking strength of the tested rope.

The rope failed after 1888 machine cycles.

EXAMPLE 1

A coating composition was prepared from a first emulsion comprising a reactive silicone polymer preformulated with a cross-linker and a second emulsion comprising a silicone polymer and a metal catalyst. The first emulsion was an emulsion available from Dow Corning containing 30.0-60.0 wt % of dimethylvinyl-terminated dimethyl siloxane and 1.0-5.0 wt % of dimethyl, methylhydrogen siloxane (Syl-off® 7950 Emulsion Coating). The second emulsion was an emulsion available from Dow Corning containing 30.0-60.0 wt % of dimethylvinyl-terminated dimethyl siloxane and a platinum catalyst (Syl-off® 7922 Catalyst Emulsion). The first emulsion and the second emulsion were mixed at a weight ratio of 8.3:1 and diluted with water to a concentration of 4 wt %.

HPPE fibers, delivered by DSM in the Netherlands as Dyneema® SK 75, 1760dtex, were dipped in the coating composition at room temperature. The fibers were heated in an oven at a temperature of 120° C. so that cross linking takes place. A rope having the same construction as described for comparative experiment A was produced from the coated HPPE fibers.

The bend fatigue of the rope was tested according to the same test method as comparative experiment A. The rope failed after 9439 machine cycles.

It can be seen by comparing the results of comparative example A and example 1 that the bend fatigue resistance of the rope was significantly improved by the cross-linked silicone coating.

COMPARATIVE EXAMPLE B

HPPE fibers, delivered by DSM in the Netherlands as Dyneema® SK 75, 1760dtex, were dipped in a coating composition containing silicone oil (Wacker C800 from Wacker Coating) at room temperature and dried. A rope having a diameter of 5 mm was produced from the coated HPPE fibers. The construction of the strands was 4×1760 dtex, 20 turns per meter S/Z. From the strands a rope was produced. The rope construction was a 12×1 strand braided rope with a 27 mm pitch. The average breaking strength of the rope was 18248 N.

The bend fatigue of the rope was tested. In this test the rope was bent over three free rolling sheaves each having a diameter of 50 mm. The three sheaves were arranged in a zig-zag formation and the rope was placed over the sheaves in such a way that the rope has a bending zone at each of the sheaves. The rope was placed under load and cycled over the sheaves until the rope reached failure. In one machine cycle the sheaves were rotated in one direction and then in the opposite direction, thus passing the rope six times over a shave in one machine cycle The stroke of this bending was 45 cm. The cycling period was 5 seconds per machine cycle. The force applied to the rope was 30% of the average breaking strength of the rope.

The rope failed after 1313 machine cycles.

EXAMPLE 2

HPPE fibers, delivered by DSM in the Netherlands as Dyneema® SK 75, 1760dtex, were coated with the coating composition as described for Example 1. A rope having the same construction as described for Comparative experiment B was constructed. Its bend fatigue was tested in the same way as Comparative example B. The rope failed after 2384 machine cycles.

It can be seen from the results of comparative example B and example 2 that the bend fatigue resistance of the rope was significantly improved by the cross-linked silicone coating compared to a non-cross linkable silicone coating.

COMPARATIVE EXAMPLE C

A rope having a diameter of 5 mm was produced from HPPE fibers delivered by DSM in the Netherlands as Dyneema® SK 75, 1760dtex. The construction of the strands was 4×1760 dtex, 20 turns per meter S/Z. From the strands a rope was produced. The rope construction was a 12×1 strand braided rope with a 27 mm pitch. The average breaking strength of the rope was 18750 N, The strand construction was 4×1760 dtex.

The bend fatigue of the rope was tested in the same way as Comparative example B. The rope failed after 347 machine cycles.

EXAMPLE 3

The rope of comparative example C was coated with the coating of Example 1 with the exception that the concentration of the mixed emulsion was 40% solid based. The rope was dipped in the coating composition at room temperature. The rope was heated in an oven at a temperature of 120° C. so that cross linking took place.

In the bend fatigue test of comparative example B the rope failed after 3807 machine cycles.

EXAMPLE 4

The rope of comparative experiment C was coated with a first emulsion: Silcolease® Emulsion 912 and a second catalyst emulsion: Silcolease® Emulsion Catalyst 913 (available from Bluestar Silicones). The first and the second emulsion were mixed at a weight ratio of 100:10 and diluted with water to a concentration of 4 wt. %. The procedure for applying the coating was the same as in Example 3.

In the bend fatigue test of comparative example B the rope failed after 1616 machine cycles.

Experiments 3 and 4 show that also when applied on a rope, the cross-linked silicone coating of the invention results in an improved bending performance over an uncoated rope (Comparative example C).

The invention claimed is:

1. A coated high strength fiber comprising a high performance polyethylene (HPPE) fiber, and a coating comprising a cross-linked silicone polymer on the fiber, wherein the cross-linked silicone polymer has a degree of cross-linking of at least 20%.

2. The coated high strength fiber according to claim 1, wherein the degree of cross-linking of the cross-linked silicone polymer is at least 30%.

3. The coated high strength fiber according to claim 1, wherein the HPPE fiber is made of ultrahigh molecular weight polyethylene (UHMWPE) having an intrinsic viscosity of at least 5 dl/g determined in decalin at 135° C.

4. The coated high strength fiber according to claim 1, wherein the coating comprising the cross-linked silicone polymer is obtained by applying a coating composition comprising a cross-linkable silicone polymer onto the fiber; and cross-linking the cross-linkable silicone polymer.

5. The coated high strength fiber according to claim 4, wherein the cross-linkable silicone polymer comprises a silicone polymer having a cross-linkable end-group.

6. The coated high strength fiber according to claim 5, wherein the cross-linkable end-group is a vinyl group.

7. The coated high strength fiber according to claim 4, wherein the cross-linkable silicone polymer has the formula:

$$CH_2{=}CH{-}(Si(CHs)_2O)_n{-}CH{=}CH_2 \quad (1)$$

wherein n is a number from 2 to 200.

8. The coated high strength fiber according to claim 4, wherein the coating composition further comprises a cross-linker having the formula:

$$Si(CH_3)_3O{-}(SiCH_3HO)_m{-}Si(CH_3)_3 \quad (2)$$

wherein m is a number of 2 to 200.

9. The coated high strength fiber according to claim 4, wherein the coating composition further comprises a platinum catalyst.

10. A rope comprising high performance polyethylene (HPPE) fibers, wherein the rope includes a coating comprising a cross-linked silicone polymer having a degree of cross-linking of at least 20%.

11. The rope according to claim 10, wherein the degree of cross-linking of the cross-linked silicone polymer is at least 30%.

12. A fishing net which comprises a coated high strength fiber according to claim 1.

13. A method of making coated high performance polyethylene (HPPE) fibers, comprising the steps of:

a) applying a coating composition comprising a cross-linkable silicone polymer to the HPPE fibers; and b) cross-linking the silicone polymer to achieve a degree of cross-linking thereof of at least 20%.

14. The method according to claim 13, wherein step b) is practiced to achieve a degree of cross-linking of at least 30%.

15. A method of making a rope comprising high performance polyethylene (HPPE) fibers, comprising the steps of:

a) applying a coating composition comprising a cross-linkable silicone polymer to the HPPE fibers;

b) cross-linking the silicone polymer to achieve a degree of cross-linking thereof of at least 20%; and c) constructing a rope from the coated fibers obtained in step b).

16. The method according to claim 15, wherein step b) is practiced to achieve a degree of cross-linking of 30%.

17. A strand comprising high performance polyethylene (HPPE) fibers, wherein the strand includes a coating comprising a cross-linked silicone polymer having a degree of cross-linking of at least 20%.

18. The strand according to claim 17, wherein the degree of cross-linking of the cross-linked silicon polymer is at least 30%.

* * * * *